US008777059B2

(12) United States Patent
Middleton

(10) Patent No.: US 8,777,059 B2
(45) **Date of Patent: *Jul. 15, 2014**

(54) LIQUID DISPENSING SYSTEMS

(71) Applicant: Boxxle, LLC, Greensboro, NC (US)

(72) Inventor: Tripp Middleton, Greensboro, NC (US)

(73) Assignee: Boxxle, LLC, Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/858,171

(22) Filed: Apr. 8, 2013

(65) Prior Publication Data

US 2013/0221030 A1 Aug. 29, 2013

Related U.S. Application Data

(63) Continuation of application No. PCT/US2011/055776, filed on Oct. 11, 2011.

(60) Provisional application No. 61/392,268, filed on Oct. 12, 2010.

(51) Int. Cl.
*B65D 35/28* (2006.01)
*B65D 35/56* (2006.01)
*B67D 3/00* (2006.01)

(52) U.S. Cl.
CPC . *B65D 35/28* (2013.01); *B67D 3/00* (2013.01)
USPC ..... 222/103; 222/95; 222/105

(58) Field of Classification Search
USPC ..... 222/103, 95, 105, 340, 386.5, 153.01, 222/153.04, 153.14, 153.13, 130, 131, 183, 222/146.1, 146.2, 146.5, 146.6
See application file for complete search history.

(56) References Cited

U.S. PATENT DOCUMENTS

| | | | | |
|---|---|---|---|---|
| 2,977,172 | A | 3/1961 | McCarten | |
| 4,179,040 | A | 12/1979 | Bateman et al. | |
| 4,722,457 | A * | 2/1988 | Bedwell et al. | 222/103 |
| 5,096,092 | A * | 3/1992 | Devine | 222/95 |
| 5,421,484 | A | 6/1995 | Beach | |
| 5,555,996 | A | 9/1996 | Lang-Ree et al. | |
| 5,685,456 | A * | 11/1997 | Goldstein | 222/95 |
| 5,803,312 | A | 9/1998 | Credle, Jr. et al. | |
| 6,062,426 | A * | 5/2000 | Bartholmey et al. | 222/1 |
| 6,223,944 | B1 * | 5/2001 | Gehl et al. | 222/94 |
| 6,708,741 | B1 | 3/2004 | Berry et al. | |
| 7,182,222 | B2 * | 2/2007 | Prabucki | 222/146.6 |
| 2002/0046981 | A1 | 4/2002 | Amish | |
| 2005/0284884 | A1 * | 12/2005 | Roy-Wedderburn | 222/105 |
| 2007/0138202 | A1 * | 6/2007 | Evers | 222/95 |
| 2009/0120956 | A1 * | 5/2009 | De La Fe Dahlin | 222/95 |
| 2010/0206901 | A1 * | 8/2010 | Alguera Gallego et al. | 222/95 |

OTHER PUBLICATIONS

Official Communication issued in International Patent Application No. PCT/US2011/055776, mailed on Mar. 9, 2012.

* cited by examiner

*Primary Examiner* — Paul R Durand
*Assistant Examiner* — Benjamin R Shaw
(74) *Attorney, Agent, or Firm* — Keating & Bennett, LLP

(57) ABSTRACT

Liquid dispensing systems for use with a bag having a pre-attached spigot are shown and described, in one example, a system includes a cavity for receiving the bag of liquid. A spigot-recess is configured to engage the spigot. A top plate assembly is locatable at or near the top of the system, the top plate assembly including a pressure plate for placing downward force on the bag of liquid. The system also includes a lifting plate for placing an upward pressure on the bag of liquid.

20 Claims, 14 Drawing Sheets

LIQUID DISPENSING SYSTEMS

RELATED APPLICATIONS

The current application claims priority to U.S. Pat. No. 61/392,268 filed 12 Oct. 2011, the entire contents of which are hereby incorporated by reference.

FIELD

The current disclosure relates generally to liquid dispensing systems, and more particularly to dispensing systems for receiving and dispensing liquid contained in a bag.

BACKGROUND

Bag-in-box (BIB) type dispensing systems are known in the art. In terms of wine, for example, traditional BIB systems include a corrugated box including a removable perforated door on the front side near the bottom of the box. A bag or bladder filled with liquid and having a pre-attached spigot is positioned inside the box such that the spigot of the bag is near the perforated door. When the perforated door is removed, the spigot is accessible and positioned within the door for use.

Traditional BIB systems are desirable for a variety of reasons including, inter alia, preventing or delaying oxidation of wine, lowering cost of manufacture, eliminating the risk of cork taint, and reducing environmental impact. For a variety of reasons, however, applicant believes there are several problems with traditional BIB systems. For example, spigots are located at the bottom of the dispensing system, thereby requiring a user to lift the dispensing system or move the dispensing system to a countertop edge to create room for filling a glass. In some situations, applicant believes gravity is insufficient to empty the contents of the bag. Further, applicant believes the aesthetic of the corrugated box may be unattractive to some consumers. Other types of traditional BIB systems likely suffer from similar problems. Accordingly, the current disclosure is addressed to at least one of the above, or additional, problems.

SUMMARY

The current disclosure is directed to a variety of liquid, e.g. wine, dispensing systems. In one example, the system includes a cavity for receiving a bag of liquid having a pre-attached spigot. The system includes a spigot-recess configured to engage the spigot. A top plate assembly is locatable at or near the top of the system, the top plate assembly including a pressure plate for placing downward force on the bag of liquid. The system also includes a lifting plate for placing an upward pressure on the bag of liquid. The lifting plate is interfaced with a lifter assembly configured to lift the lifting plate.

When a bag is positioned within the cavity, the top plate assembly is closed and the pressure plate of the top plate assembly is capable of exhibiting a downward force on the bag of liquid. The lifting plate places an upward pressure on the bag of liquid in an amount sufficient to raise the bag as liquid is removed. The results include a variety of efficient dispensing systems that allow users to readily access liquid in a bag. Further, in many examples, systems will allow users to access liquid in a bag without manipulating the system (e.g. lifting, tilting, sliding to the edge, etc.). Further, in many examples, systems will allow the users to empty a liquid volume in the range of 90% to 100% of total liquid volume, without requiring manipulation of the system.

The above summary was intended to summarize aspects of the present disclosure. Systems and methods will be set forth in more detail in the figures and detailed description below. It will be apparent, however, that the detailed description is not intended to limit the present invention, the scope of which should be properly determined by the appended claims.

DETAILED DESCRIPTION OF VARIOUS EMBODIMENT EXAMPLES

Figure 1:
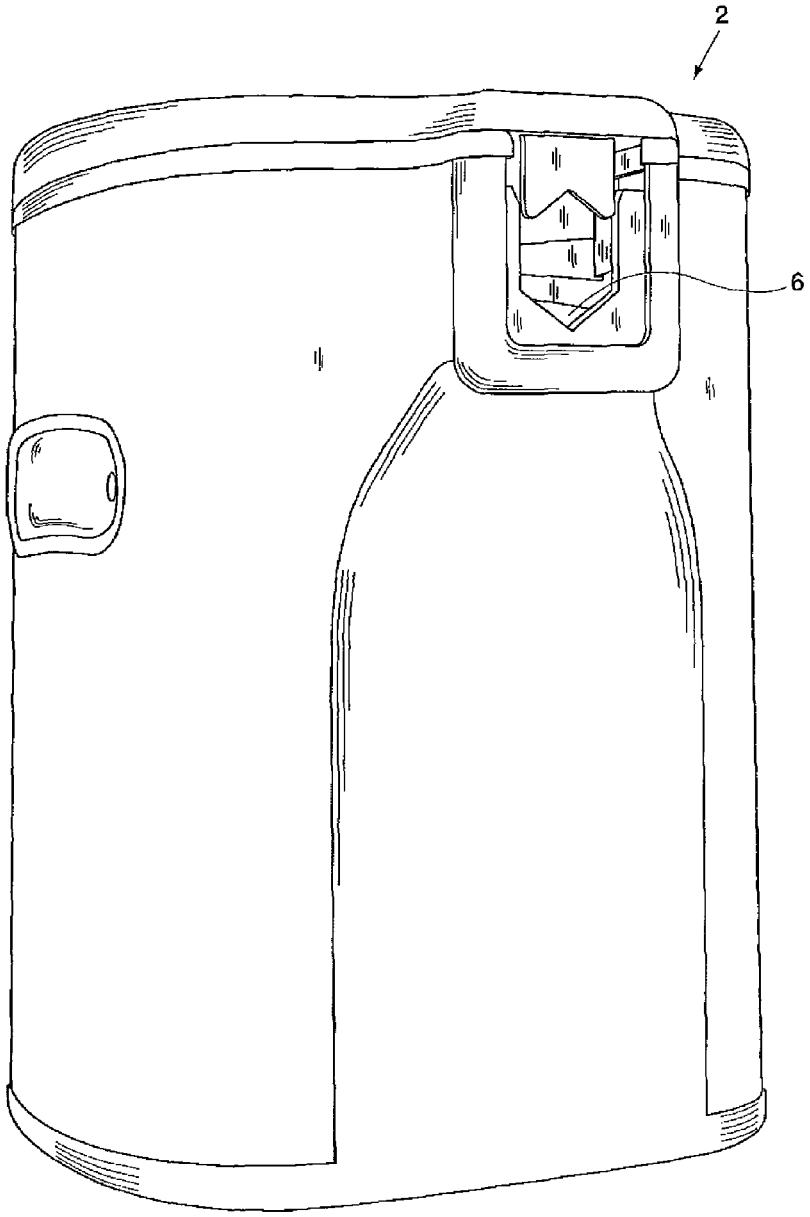
FIG. 1 illustrates a perspective view of one example of a liquid dispensing system as described herein.
Figure 2:
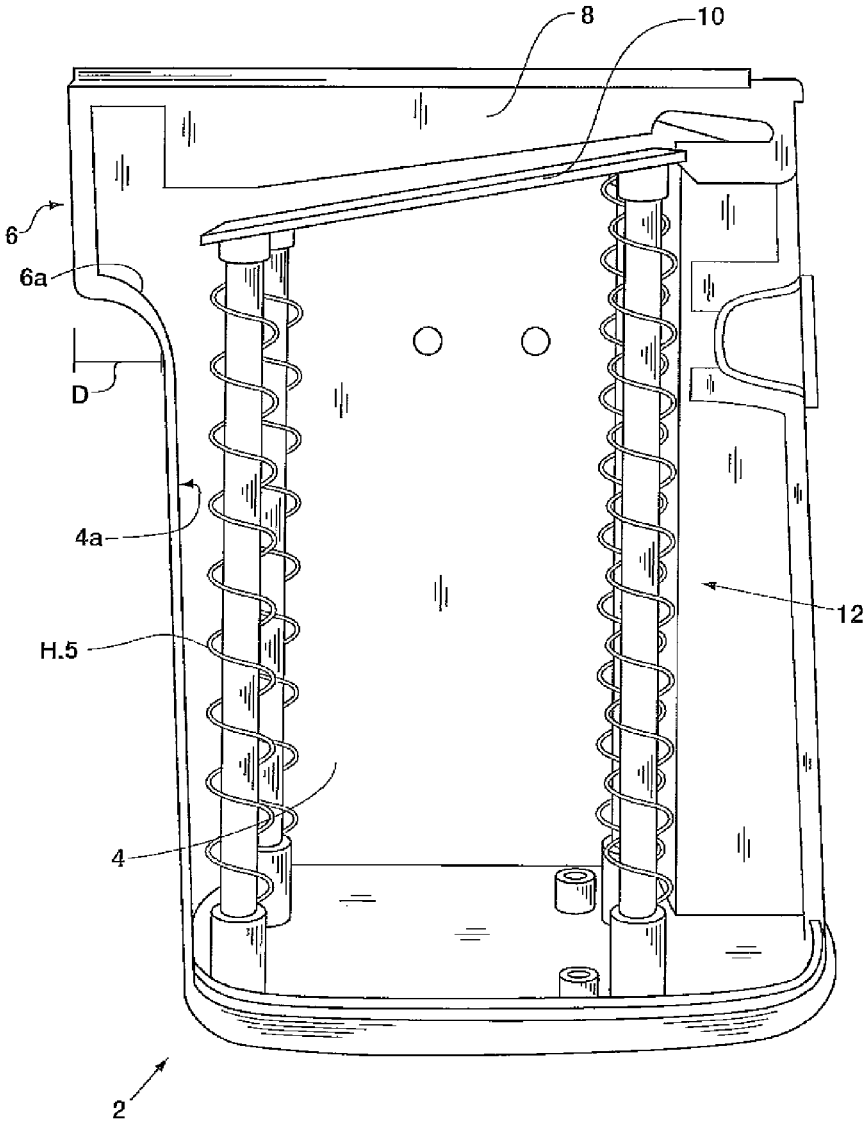
FIG. 2 shows a cutaway side view of a liquid dispensing system example.

The current disclosure is inclusive of a variety of liquid dispensing systems for dispensing liquid from a bag having a pre-attached spigot. FIGS. 1-13 illustrate various views of one system example, are also useful for describing a variety of additional examples. FIG. 1 shows a perspective view of one example of a liquid dispensing system as described herein. FIG. 2 shows a cutaway side view of system 2, which allows for the visualization of various components. Referring generally to FIG. 2, system 2 includes a cavity 4 for receiving a bag of liquid having a spigot (not shown in this figure); a spigot recess 6 shaped to engage the spigot; a top plate assembly 8; a lifting plate 10; and a lifter 12. System components will be explained in more detail below.

Figure 3:
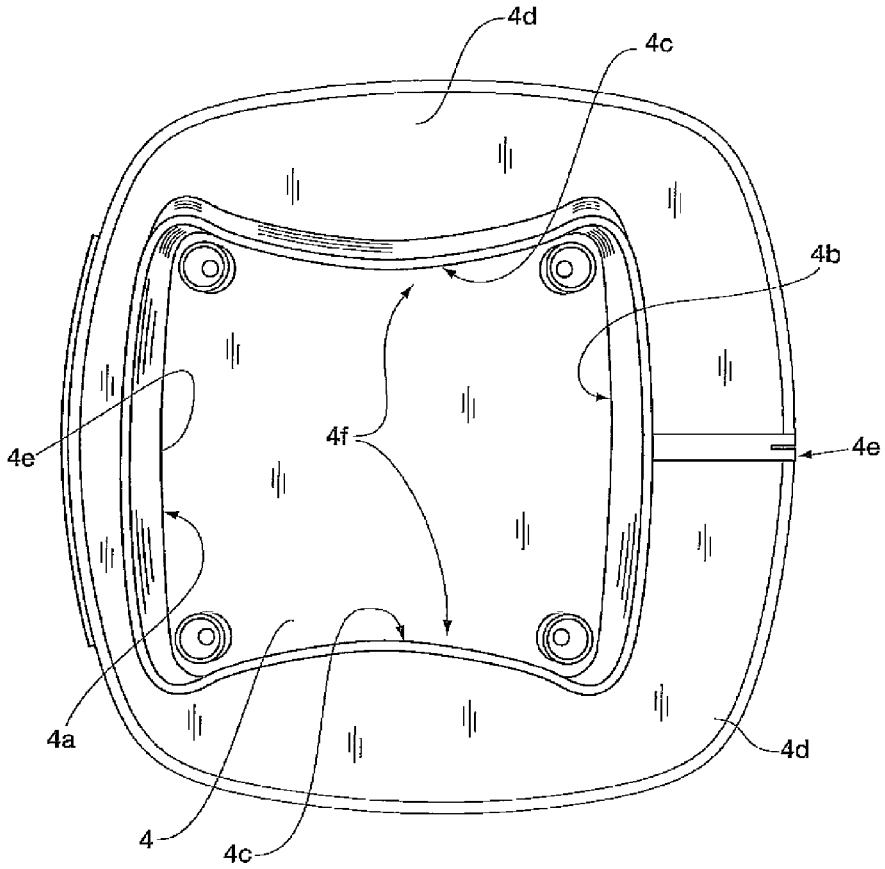
FIG. 3 shows a partial internal cutaway view of the bottom of a liquid dispensing system example.

FIG. 3 shows a cutaway top view of cavity 4. A variety of cavity shapes and sizes may be used for receiving the bag of liquid. In this example, cavity 4 includes front wall 4*a*, back wall 4*b*, and a pair of lateral walls 4*c*. Walls may be solid or non-solid and may be made from any number of components. In the example shown, walls 4*a*, 4*b*, and 4*c* are defined by a pair of cavity caps 4*d* that mate along line 4*e*.

Cavity volume may vary from example to example, for example, to accommodate various volumes of liquid contained in a bag. In many examples, e.g., those for wine, cavities will be configured to receive a bag containing approximately 3 liters of liquid. Other examples may be configured to receive more or less. Some system examples may also include more than one cavity, e.g., two, three, four, etc.

In many examples, at least one of the walls of the cavity, e.g. one of the front, back or lateral walls, will include an inwardly facing guide surface. For example, lateral surface 4*c* may be considered to include an inward bend 4*f*, for inter alia, directing liquid contents in a bag inwardly. In the example shown both of the lateral walls include an inwardly bend. The inwardly facing guide surface may extend from about the bottom-most position of the lifting plate to about the top-most position of the lifting plate.

Figure 4:
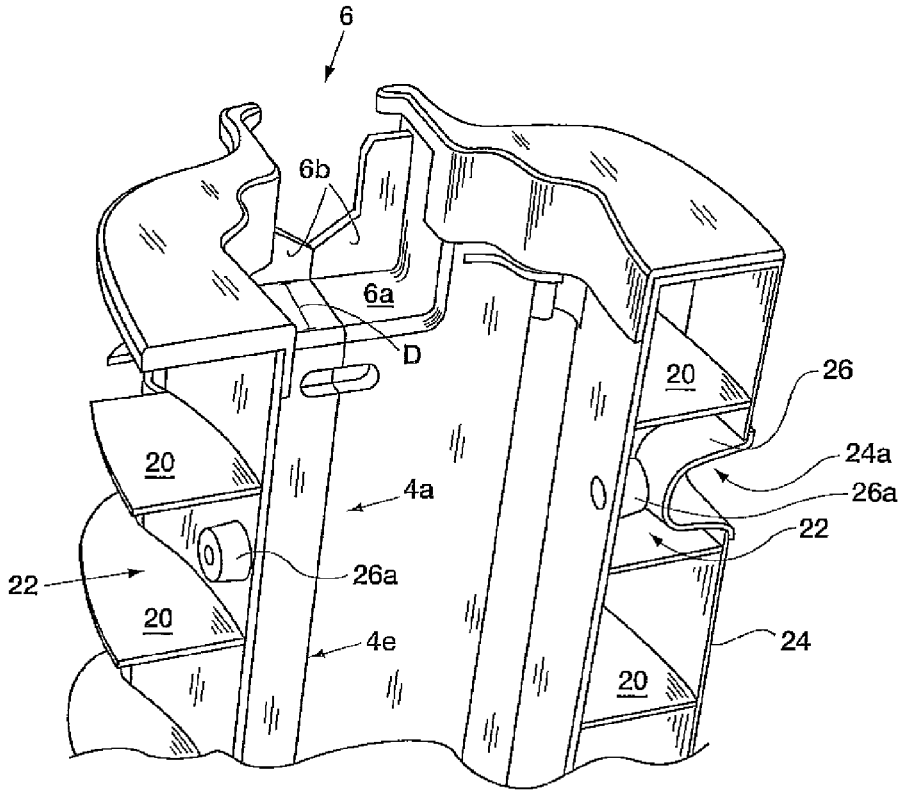
FIG. 4 shows a partial internal cutaway view of the front of a liquid dispensing system example.

Referring back to FIG. 2, the front wall of the cavity, e.g., front wall 4*a*, will have an upper half, e.g. the portion of above H.5, and spigot recess 6 will be defined in the upper half. In some examples, the spigot recess will be in the upper third, the upper forth, or at the very top of the front wall. FIG. 4 illustrates an internal view of front wall 4*a* including spigot recess 6.

Spigot recesses will in many examples be cantilevered relative to the front wall a distance sufficient to allow a drinking glass to be positioned, at least in part, under a spigot positioned within the spigot-recess. One cantilevering example is illustrated, inter alia, in FIG. 2 and FIG. 4. In this example, front wall portion 6*a* extends distally for a distance D. Distance D may vary from example to example. For example, if a spigot has a length L from its bag interface to the distal edge, then D may be in the range of 0.5L to 4L. In this example, the cantilevered portion is substantially horizontal, but it other examples, cantilevered portions may be non-horizontal, include non-horizontal portions, etc. Further, while in this example, portion 6*a* is defined by the front wall, in other examples, other structures may be used to cantilever, e.g. beams, flanges, etc. Some system examples, e.g. those including a plurality of cavities, may also include a plurality of any of the variety of spigot recesses.

Spigot recesses may also include a downward taper defined at the bottom of the spigot recess. FIG. 4 illustrates one example of a downward taper 6*b* defined by a spigot recess. Downward tapers are useful for improving the secure interface of the spigot in the spigot recess. Sizes may vary based on spigot size. For example, the upper end of the taper may be larger than the diameter of the portion of the spigot neck configured to be received in the spigot recess, and the bottom end of the taper may be approximately the same size, or smaller, than the portion of the spigot neck configured to be received by the spigot recess.

Figure 5:
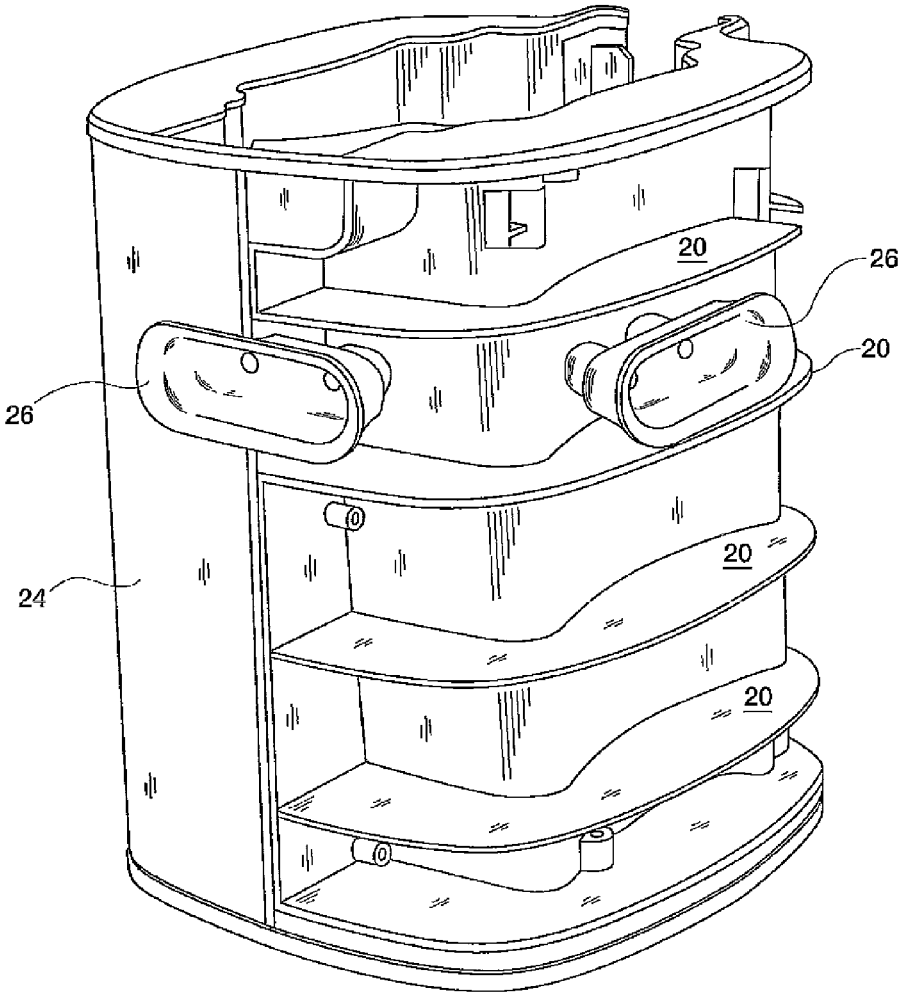
FIG. 5 shows a partial external perspective view of a liquid dispensing system example.

Cavities may also include a plurality of external ribs to, inter alia, create a desired final shape of the system, define at least one handle hole to facilitate moving the system, etc. In FIG. 4, a plurality of external ribs 20 are visible. In this example, the ribs are oriented with substantially horizontal planes and are spaced vertically, however, other examples, include other orientations, e.g., vertical planes with horizontal spacing, etc. As seen, ribs define at least one handle chamber 22. Systems may additionally include an external shell 24 located, at least in part, distally to the external ribs. The external shell on the left hand side of the system has been removed to facilitate viewing. In many examples, the external shell will additionally include at least one handle hole, e.g., handle hole 24*a*, configured to align with at least one handle chamber, e.g. chamber 22. The resulting void may define a handle for moving or manipulating the system. Some examples may further include, for aesthetic reasons for example, a handle structure, e.g, structure 26, positioned within the handle hole 24*a* and the handle chamber. If a handle is desired, the handle may be interfaced with a variety of fasteners represented by fastener portion 26*a*. FIG. 5 illustrates another view of ribs 20, shell 24 and handle 26. Cavities may additionally include spaces for heating or cooling elements, e.g., ice packs for white wine, heating packs for cider, etc. Heating an cooling elements may also include compressors for cooling and electric heating strips for heating. These types of elements may be positioned in a variety of locations, e.g. within voids defined by ribs or adjacent to internal walls, etc.

Figure 6A:
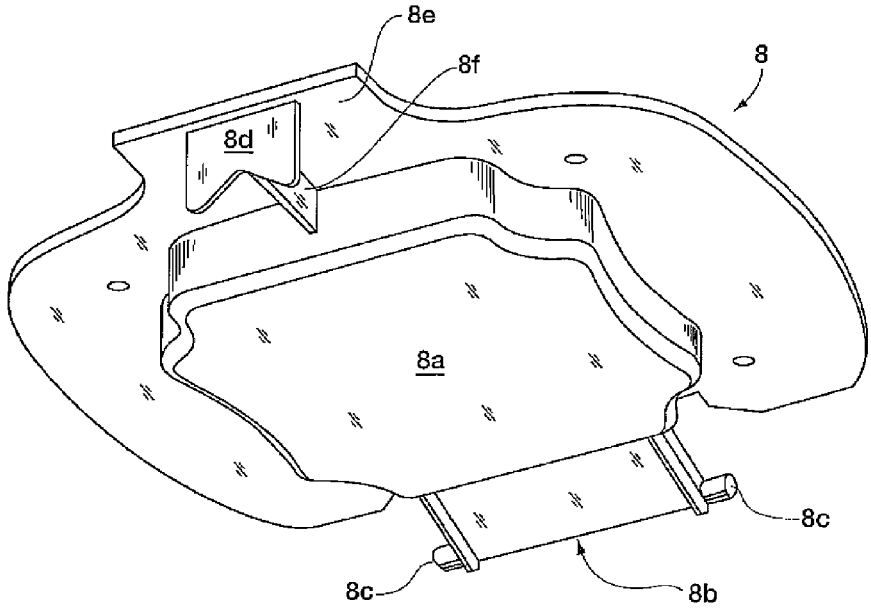
FIGS. 6*a* and 6*b* illustrate isolated views of a top plate assembly example.
Figure 6B:
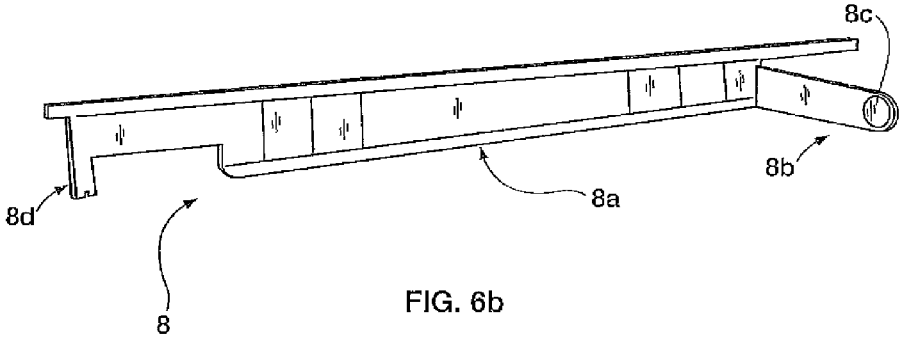

FIGS. 6*a* and 6*b* show various isolated views of top plate assembly 8. Top plate assembly 8 includes a pressure plate 8*a* for being positioned in the top of the cavity and placing a downward force on the bag of liquid. Top plate assembly 8 is configured to have an open position, e.g. for allowing a bag of liquid to be placed within the cavity, and a closed position, e.g. for fixedly positioning the pressure plate to place a downward force. The open and closed positions may be achieved in a variety of ways. For example, the top plate assembly may be completely detachable from the other components of the system, wherein the open position includes a detachment of the top plate assembly, and a closed position includes an attachment of the top plate assembly. In some examples, the top plate assembly may be slideably receivable by grooves on an upper portion of the system, wherein the open positioned includes a distal sliding of the top plate assembly such that a bag of liquid may be positioned in the cavity, and a closed position includes a sliding of the top plate assembly such that the pressure plate is at least partially aligned with the cavity. In some examples, the top plate assembly may be pivotally mounted to the system. Referring to FIGS. 6*a* and 6*b* for example, top plate assembly 8 includes hinge arm 8*b* ending from pressure plate 8*a* and having pivot points 8*c* for pivotal mounting. In this example, when top plate assembly is pivoted upwardly to allow access to the cavity it is in its open position, and when top plate assembly is pivoted downwardly to position pressure plate 8*a* in its position for providing downward pressure, it is in its closed position. Other hinges may be used.

Top plate assemblies may also include a spigot-recess cap, e.g spigot-recess cap 8*d*, configured to abut the top of the spigot recess, for example, to improve the purchase on a spigot contained within the spigot recess. In many examples, the spigot-recess cap will be cantilevered relative to the front wall a distance sufficient to be proximal to the spigot recess, e.g. similar to distance D of the spigot recess cantilever. In the example shown, cap 8*d* is cantilevered by portions 8*e* and 8*f* of the top plate assembly. In other examples, caps may be cantilevered in other ways, e.g. a pair of parallel beams, etc. Further, in examples including multiple cavities, an combination of multiple top plate assemblies may be used.

Figure 7:
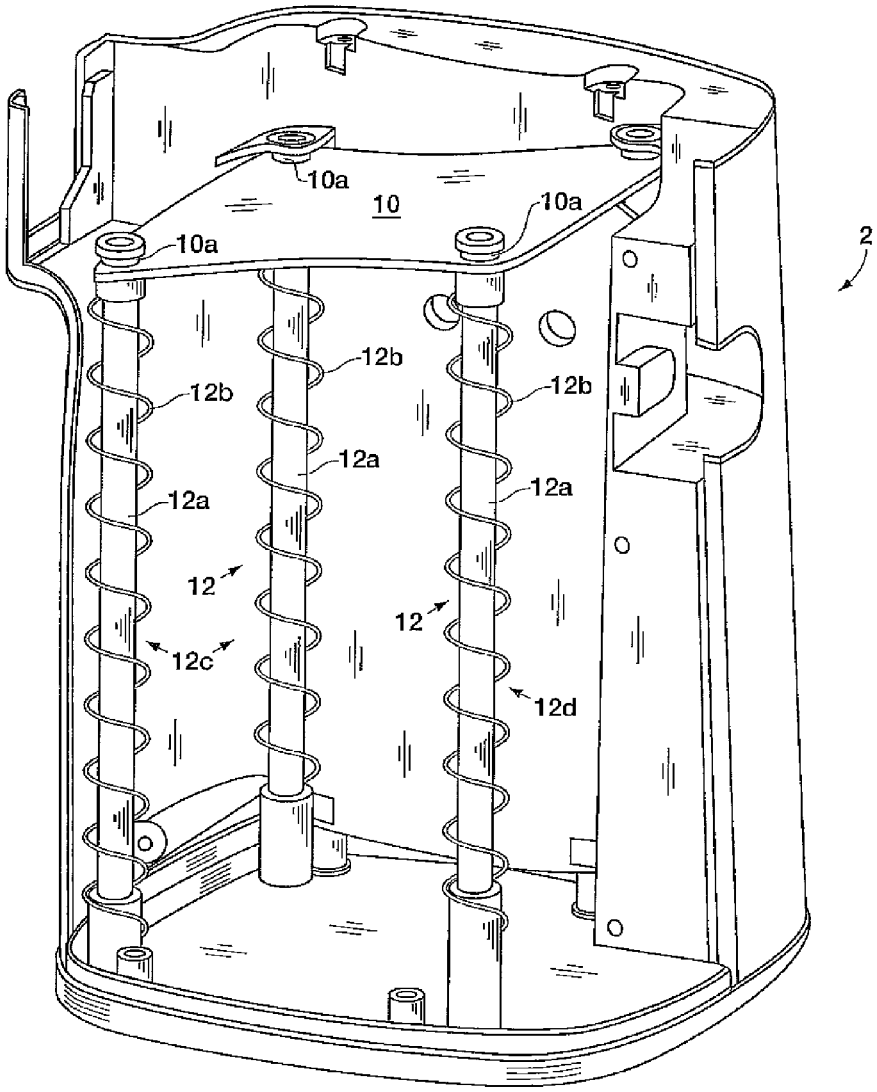
FIG. 7 shows a perspective view of a liquid dispensing system example with various components removed to facilitate viewing.

FIG. 7 illustrates a perspective view of system 2 with various components removed to facilitate viewing of lifting plate 10, which is interfaced with lifter assembly 12. Typically, the lifter assembly will include at least one guide interfaced with the lifting plate and at least one biasing device, e.g. a spring, attached to provide a biasing force to the lifting plate. The at least one guide orients vertical ascent and decent of the lifting plate, and the at least one biasing device biases the lifting plate in the direction of the pressure plate.

Guides may vary. For example, they may include at least one channel defined in the side of the chamber for receiving a portion of the lifting plate or they may include at least one post interfaced with a void in the lifting plate. In the example shown in FIG. 7, guides include a plurality of guide posts 12*a*, interfaced with lifting plate 10 through voids 10*a* defined in the lifting plate. The lifter assembly's biasing device includes a plurality of springs 12*b* surrounding the guide posts. In other examples, voids may be in other locations, e.g. closer to the perimeter of the lifting plate such that they are only partially defined by the lifting plate. Springs or other biasing devices may similarly be attached in a variety of fashions at a variety of locations. In some examples, guides may include telescoping structures that collapse on themselves when a bag of liquid is contained within the cavity, and which may extend with spring biasing, e.g. as liquid is removed from the bag. Further, in examples including multiple cavities, any combination of multiple lifter assemblies may be used.

In this example, guide posts 12*a* may be considered to include a front pair of guide posts 12*c* and a rear pair of guide posts 12*d*, with the lifting plate including a front pair of apertures to receive the front pair of guide posts and a rear pair of apertures to receive the rear pair of guideposts, Springs 12*b* include compression springs designed to store energy when compressed. Spring force may vary depending on, for example, the number of springs used, the size of the volume or weight of the liquid being received by the chamber, etc. Typically, for most consumer beverages, springs will be configured such that a lifting plate can be depressed by a weight in the range of at least one of about 6 lb to about 13 lb, and about 0.5 to about 3 lb. In some examples, e.g., systems for dispensing liquid from 9 liter bags, springs may be configured to provide a lifting force in the range of 20-40 lbs. Different numbers of biasing devices, e.g a different number of springs, may be used to achieve the desired biasing force. Springs may be configured to have a lifting force sufficient to move the lifting plate upward as liquid is removed from the bag. In some examples, springs will be configured to have a greater lifting force than the downward force created by the full bag of liquid. In such examples, a user may apply additional downward force to the depress the lifting plate an amount sufficient to move the top plate assembly to a closed position.

Figure 8:
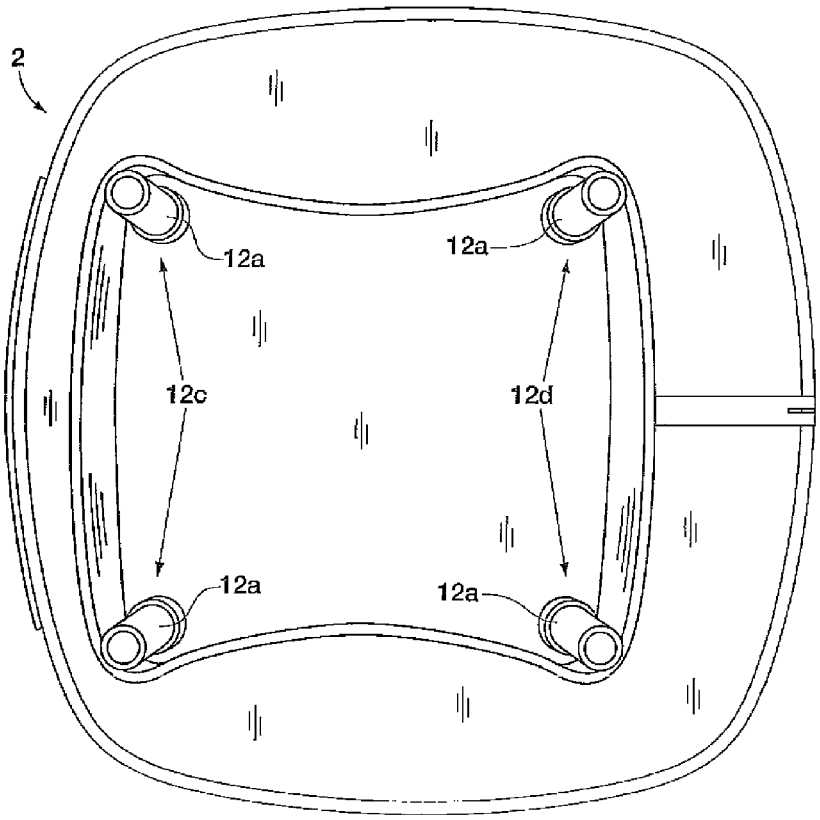
FIG. 8 shows a partial internal cutaway view of the bottom of a liquid dispensing system example, illustrating a guide post example.
Figure 9:
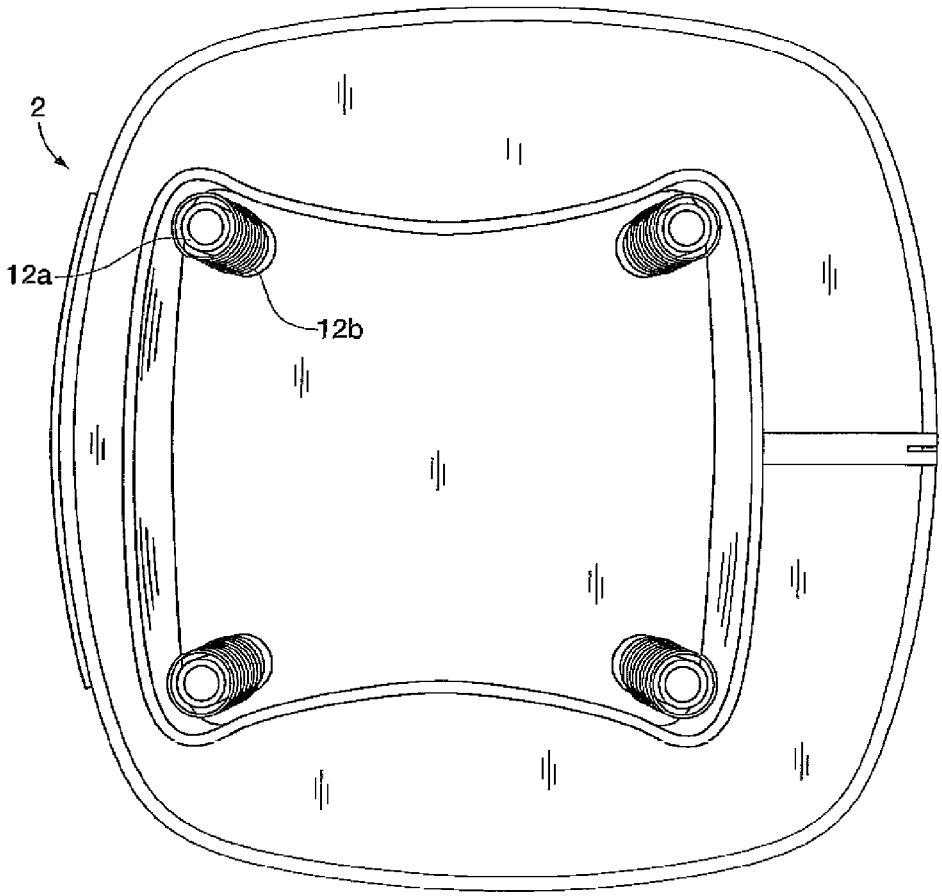
FIG. 9 shows a partial internal cutaway view of the bottom of a liquid dispensing system example, illustrating a guide post and spring configuration example.

FIG. 8 illustrates a partial cutaway views of system 2 further illustrating guides 12*a*. FIG. 9 illustrates the view of FIG. 8, further including springs 12*b* positioned around guides 12*a*.

Figure 10:
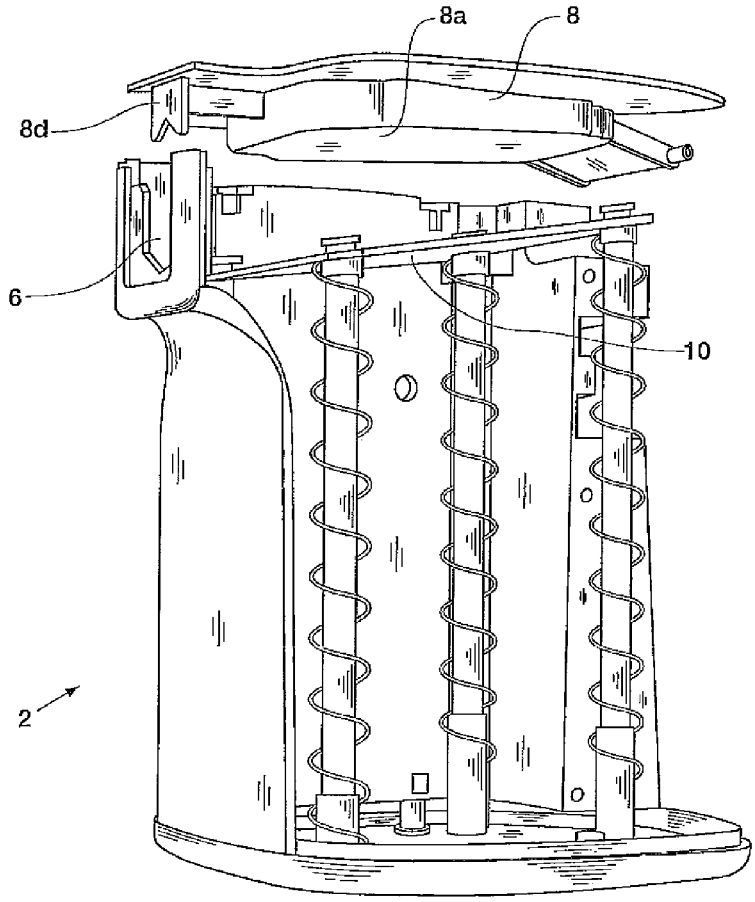
FIG. 10 shows a perspective view of a liquid dispensing system example with various components removed to facilitate viewing.

FIG. 10 illustrates another view of system 2 with top plate assembly 8 raised and wall portion removed to facilitate viewing. Pressure plate 8*a* is shown with at least a portion vertically aligned with lifting plate 10. Further, spigot-recess cap 8*d* is illustrated as cantilevered and just above spigot recess 6. By lowering top plate assembly 8 slightly, such as when in use, spigot-recess cap 8*d* will abut spigot recess 6.

Figure 11:
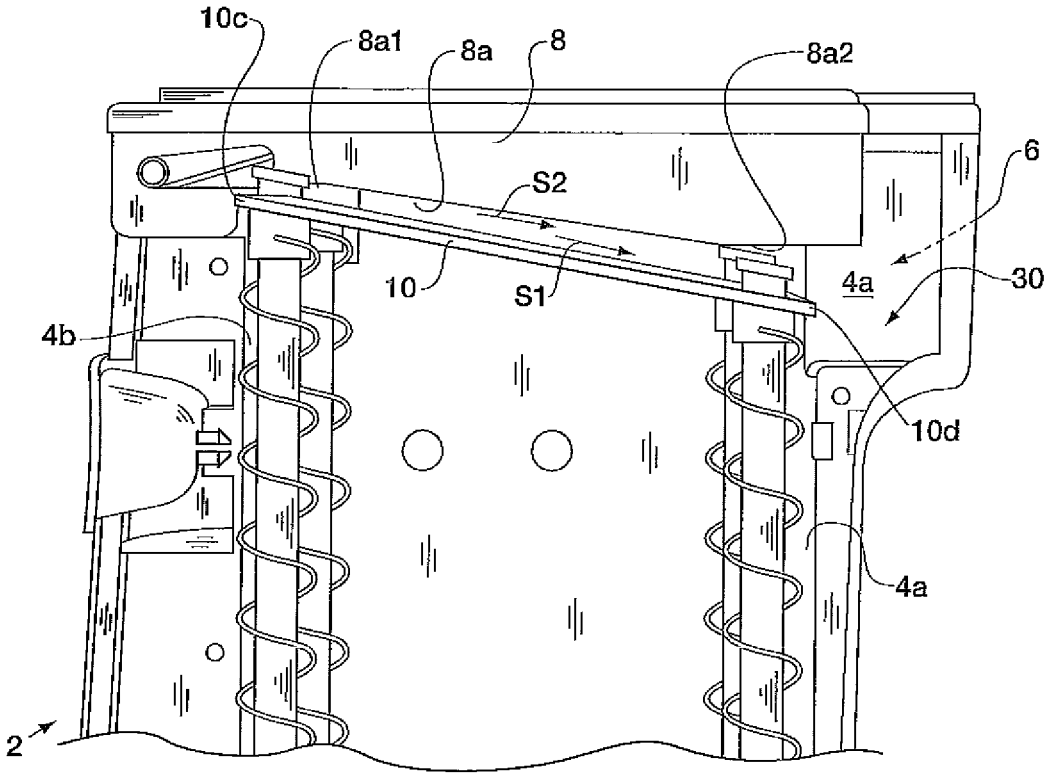
FIG. 11 shows a cutaway close up view of a liquid dispensing system example.

In many examples, at least one of the lifting plate and the pressure plate will include a downward slope in the direction of the spigot recess. FIG. 11 illustrates a close up partial side view of system 2 useful for illustrating, inter alia, the slope of the lifting plate. Lifting plate 10 may be considered to have a bottom end 10*d* (e.g. proximal to the front wall 4*a*) and a top end 10 (e.g. proximal to the back wall 4*b*) where the bottom end is lower than the top end, thereby creating a first slope with a direction of slope indicated by arrow S1. When the lifting plate is in its top-most position, e.g. as shown, the position, the bottom end 10*d* of the first slope is positioned proximal to spigot-recess 6.

As noted, the pressure plate may similarly include a downward slope. In this example, pressure plate 8*a* includes a top end 8*a*1 and a bottom end 8*a*2 that is lower than the top end. Top end 8*a*1 is positioned proximal to back wall 4*b* and bottom end 8*a*2 is positioned proximal to front wall 4*a*. Bottom end 8*a*2 may be positioned proximal to the spigot-recess when the pressure plate assembly is in its closed position. Pressure plate 8*a*, accordingly includes a second slope with the direction of slope indicated by arrow S2. In this example, S1 and S2 are similar, but in other examples, first and second slopes may have different values.

FIG. 11 also illustrates pooling chamber 30 positioned between the bottom end of the first slope 10*d* and the spigot-recess 6. The pooling chamber may further be defined, at least in part by portions of the front wall, e.g. 4*a* and the cantilevered portion of the spigot recess. Pooling chambers may allow, inter alia, a portion the bag containing liquid to be positioned therein, whereby liquid may collect. In some examples, pooling chambers will further allow liquid contents in a bag to pool for improved extraction from the bag of liquid. Liquid pooling chambers may similarly serve as a decompression chamber, for example, to maintain a more consistent flow rate when liquid is being dispensed.

Figure 12:
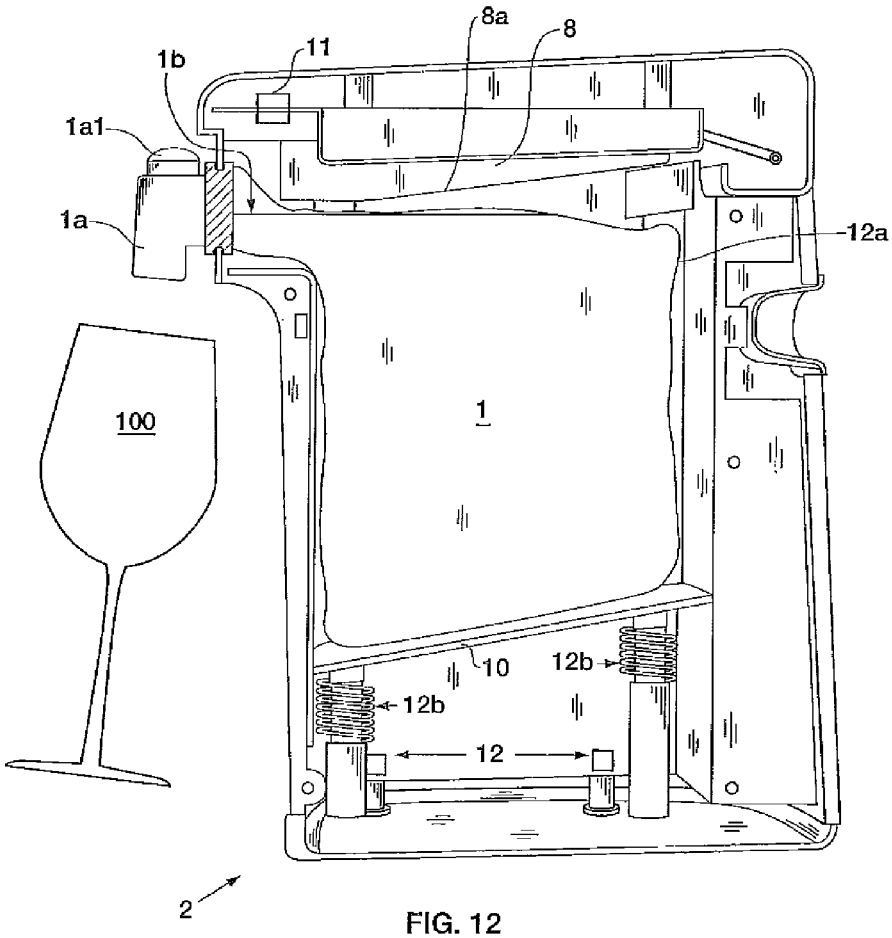
FIGS. 12 and 13 illustrate a liquid dispensing system example in use.

FIG. 12 illustrates one example of a system containing a bag of liquid 1 having a pre-attached spigot 1*a*. Bag 1 is positioned on top of lifting plate 10, and the downward force of bag 1 depresses the lifting plate. Springs 12*b* of the lifting mechanism 12 are compressed. Top plate assembly 8 is in its closed position, thereby allowing pressure plate 8*a* to place a downward force in areas where it comes into contact with bag 1. Top plate assembly 8 latched in its closed position by latch 11. A variety of latches, e.g., spring, slam, cam, Norfolk, Suffolk, crossbar, cabin hook, bolt, compression, rotary, etc. may be used to secure the top plate assembly. Latches may be located in a variety of locations, e.g. the side front or back of the system. A drinking glass 100 is positioned under spigot 1*a*. A user desiring liquid from bag 1 may open spigot 1*a*, e.g by operating valve through button 1*a*1, thereby allowing liquid to flow into the glass. Spigot valves may vary, including for example, various levers, screw valves, push button valves, etc. As liquid released from bag 1, the lifting assembly continues to lift the bag of liquid, thereby maintaining a liquid level, e.g. 1*b* in contact with spigot 1*a*.

Figure 13:
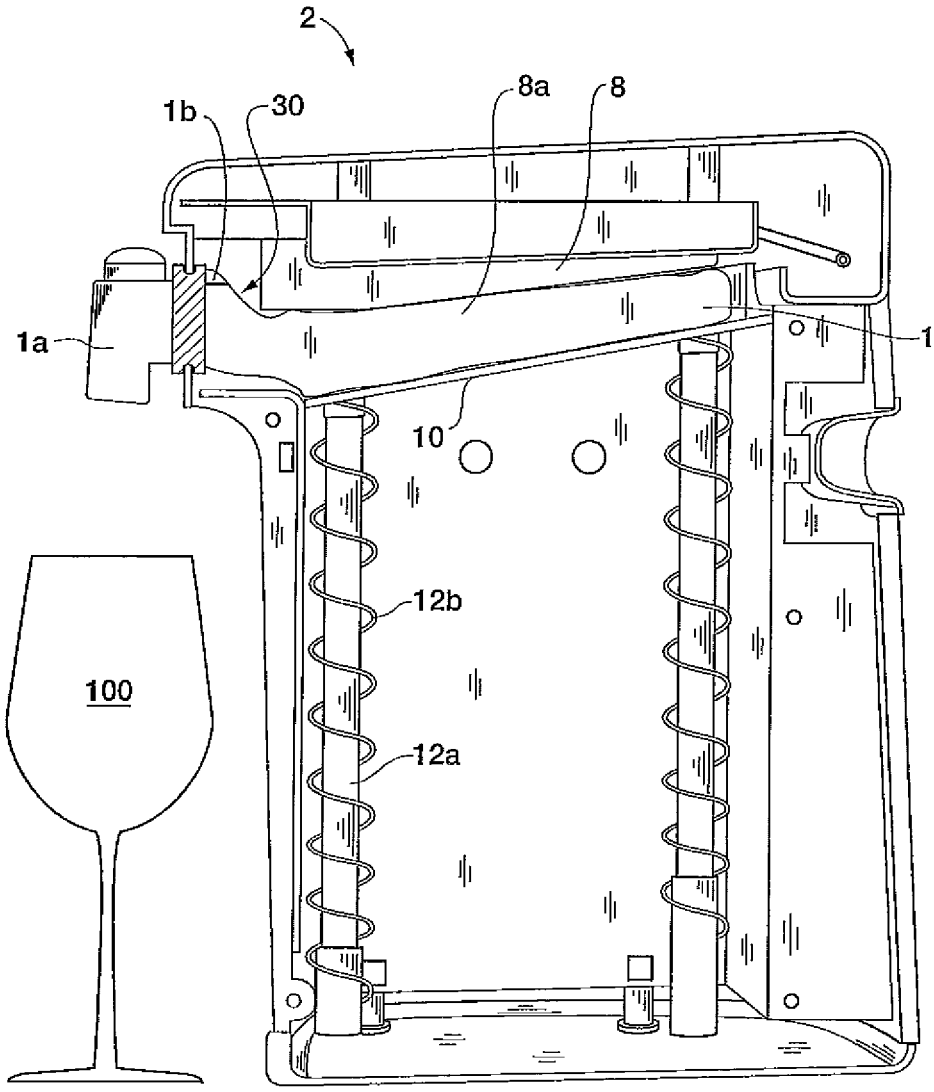

FIG. 13 illustrates system 2 after most of the liquid has been removed from bag 1. Bag 1 is compressed between lifting plate 10 and pressure plate 8*a*, thereby forcing the last remaining liquid into pooling chamber 30 as illustrated by liquid level 1*b*. As illustrated, liquid in bag 1 can readily be accessed without the manipulation, e.g. lifting, tilting, sliding to the edge, etc. of the system. Further, in many examples, systems will allow the users to empty a liquid volume range of 90% to 100% of total liquid volume, 95% to 100% of total liquid volume, and 97% to 100% of total liquid volume without requiring manipulation of the system.

FIGS. 12 and 13 are also useful for illustrating the top-most and bottom-most positions of the lifting plate. In many examples, the top-most and bottom-most positions of the lifting plate will be related to the lifter assembly. For example, in FIG. 12, the bottom-most position of the lifting plate is determined by the height of springs 12*b* when fully compressed, and the top-most position will be determined by the lifting plate's interface with the guide.

Figure 14:
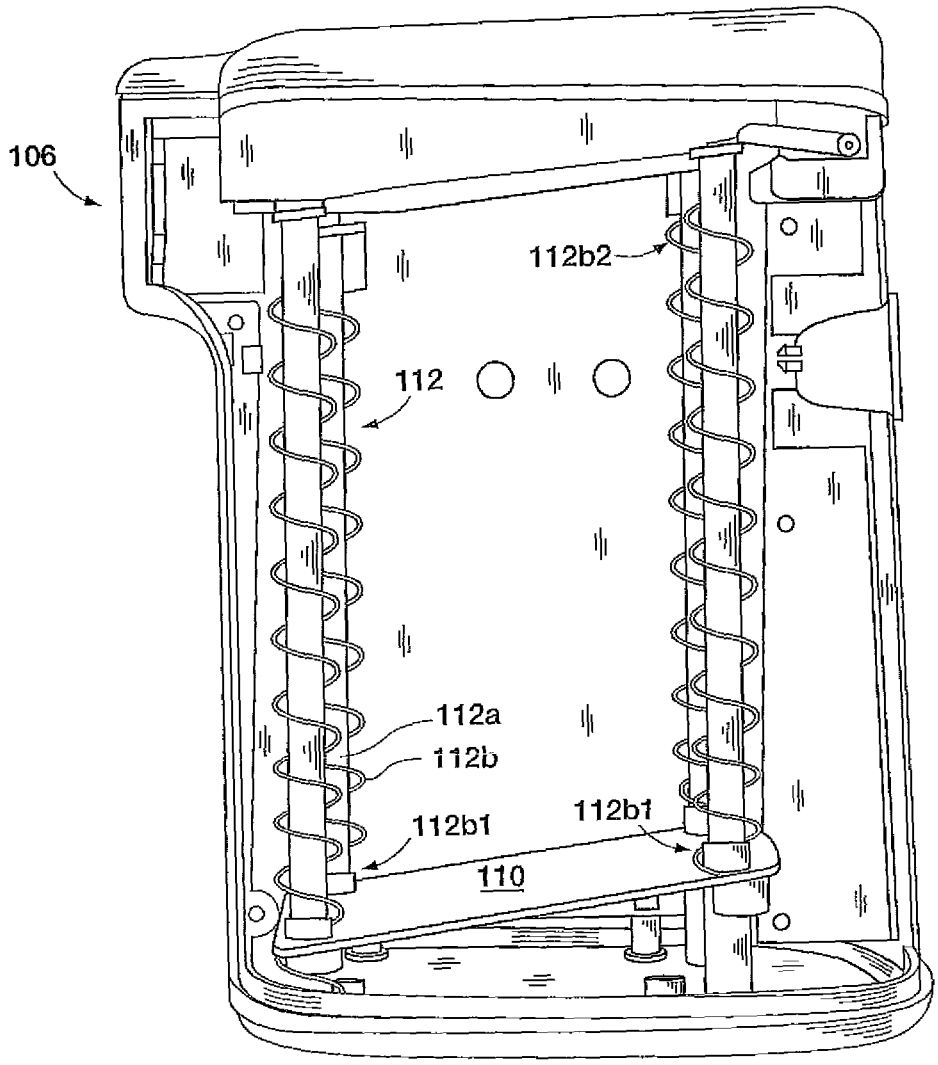
FIG. 14 illustrates an example of another embodiment of a liquid dispensing system.

FIG. 14 illustrates another system example, referred to as system 102. System 102 is generally similar to system 2, however, the lifter assembly 112 has a slightly different configuration. Lifter assembly 112 uses tension springs 112*b* which store their energy when extended as shown. In this example, tension springs 112*b* attached to the lifting plate near their bottom ends, e.g. 112*b*1, and are fixedly attached near their upper ends, e.g. 112*b*2, to some higher point in the system. In this example, springs ends 112*b*2 are fixedly attached to a higher portion of guide posts 112*a*, but in other examples, they may be attached in other places, e.g to a wall or top plate assembly.

In the illustration shown, lifting plate 110 may be considered to be in its bottom-most position, e.g. springs 112*b* are fully extended. In its top-most position, springs 112*b* would be relaxed and the bottom end of lifting plate 110*b* would typically be proximal to spigot recess 106. Spring tensions, in this example may be similar to those previously described.

In other examples, lifter assemblies may include other devices for providing an upward biasing force, e.g. a piston in communication at one end with the lifting plate and with a supply of compressed fluid, e.g. air or liquid, for raising the piston; screw drives, motor lifts, etc.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent. It should also be clear that the various system examples, are not intended to be mutually exclusive, and that various parts from one example may be used in another example as described herein.

What is claimed is:

1. A liquid dispensing system for use with a bag of liquid including a spigot, the system comprising:

a cavity arranged to receive the bag of liquid, wherein the cavity includes a front wall including an upper half portion, a back wall, and a pair of lateral walls;

a spigot-recess defined on the front wall of the cavity and shaped to engage the spigot, wherein the spigot-recess is located in the upper half portion of the front wall;

a top plate assembly arranged to be alternatingly positioned between an open position and a closed position, the top plate assembly including a pressure plate positioned at a top of the cavity, the pressure plate arranged to apply a downward force on the bag of liquid;

a lifting plate arranged to lift the bag of liquid and to apply an upward force on the bag of liquid, the lifting plate arranged to move in the cavity between a bottom-most position and a top-most position which is different from the bottom-most position;

a lifter assembly interfaced with the lifting plate, the lifter assembly arranged to move the lifting plate to the top-most position; wherein the lifting plate includes a first slope including a top end and a bottom end that is lower than the top end, the top end of the first slope being positioned proximal to the back wall and the bottom end of the first slope being positioned proximal to the front wall;

when the lifting plate is in the top-most position, the bottom end of the first slope is positioned proximal to the spigot recess, and a pooling chamber is defined between the bottom end of the first slope and the spigot-recess at a position spaced away from and below the bottom end of the first slope, the pooling chamber including a bottom surface adjacent to the spigot-recess; and the spigot-recess is arranged to support the spigot of the bag of liquid such that when the spigot is operated, liquid will be extracted through the spigot directly from a portion of the bag of liquid which is supported within the pooling chamber.

2. The system of claim 1, wherein at least one of the walls of the cavity includes an inwardly facing guide surface.

3. The system of claim 2 wherein the inwardly facing guide surface extends from about the bottom-most position of the lifting plate to about the top-most position of the lifting plate.

4. The system of claim 1, wherein each of the pair of lateral walls includes an inwardly facing guide surface extending from at least the bottom-most position of the lifting plate to at least the top-most position of the lifting plate.

5. A liquid dispensing system for use with a bag of liquid including a spigot, the system comprising:

a cavity arranged to receive the bag of liquid, wherein the cavity includes a front wall including an upper half portion, a back wall, and a pair of lateral walls;

a spigot-recess defined on the front wall of the cavity and shaped to engage the spigot, wherein the spigot-recess is located in the upper half portion of the front wall;

a top plate assembly arranged to be alternatingly positioned between an open position and a closed position, the top plate assembly including a pressure plate positioned at a top of the cavity, the pressure plate arranged to apply a downward force on the bag of liquid;

a lifting plate arranged to lift the bag of liquid and to apply an upward force on the bag of liquid, the lifting plate arranged to move in the cavity between a bottom-most position and a top-most position which is different from the bottom-most position; and a lifter assembly interfaced with the lifting plate, the lifter assembly arranged to move the lifting plate to the top-most position; wherein the cavity further includes a plurality of external ribs on an outside surface of at least one of the lateral walls, the external ribs defining at least one horizontal handle chamber, and the system further includes an external shell located outward of the external ribs, wherein the external ribs define at least one handle hole arranged to align with the at least one horizontal handle chamber.

6. The system of claim 1, wherein the spigot-recess is cantilevered relative to the front wall at a distance so as to define a clearance beneath the spigot-recess, the clearance is arranged to allow a drinking glass to be positioned, at least in part, under the spigot engaged with the spigot-recess.

7. The system of claim 1, wherein the spigot-recess includes a downward taper defined at a bottom of the spigot-recess.

8. The system of claim 7, wherein the top plate assembly further includes a spigot-recess cap configured to abut a top of the spigot-recess.

9. The system of claim 8, wherein the spigot-recess cap is cantilevered relative to the front wall.

10. A liquid dispensing system for use with a bag of liquid including a spigot, the system comprising:

a cavity arranged to receive the bag of liquid, wherein the cavity includes a front wall including an upper half portion, a back wall, and a pair of lateral walls;

a spigot-recess defined on the front wall of the cavity and shaped to engage the spigot, wherein the spigot-recess is located in the upper half portion of the front wall;

a top plate assembly arranged to be alternatingly positioned between an open position and a closed position, the top plate assembly including a pressure plate positioned at a top of the cavity, the pressure plate arranged to apply a downward force on the bag of liquid;

a lifting plate arranged to lift the bag of liquid and to apply an upward force on the bag of liquid, the lifting plate arranged to move in the cavity between a bottom-most position and a top-most position which is different from the bottom-most position; and a lifter assembly interfaced with the lifting plate, the lifter assembly arranged to move the lifting plate to the top-most position; wherein the spigot-recess includes a downward taper defined at a bottom of the spigot-recess;

the top plate assembly further includes a spigot-recess cap configured to abut a top of the spigot-recess; and the spigot-recess cap includes an upward taper.

11. The system of claim 1, wherein the top plate assembly includes a hinge near the back wall of the cavity arranged to allow pivotal movement between the open position and the closed position.

12. The system of claim 1, further including a clasp arranged to secure the top plate assembly in the closed position such that the pressure plate is prevented or substantially prevented from moving upward.

13. The system of claim 1, wherein the pressure plate of the top plate assembly is vertically aligned with the lifting plate.

14. The system of claim 1, wherein the lifting plate includes a first slope including a top end and a bottom end that is lower than the top end, the top end of the first slope being positioned proximal to the back wall and the bottom end of the first slope being positioned proximal to the front wall.

15. The system of claim 14, wherein, when the lifting plate is in the top-most position, the bottom end of the first slope is positioned proximal to the spigot recess.

16. A liquid dispensing system for use with a bag of liquid including a spigot, the system comprising:

a cavity arranged to receive the bag of liquid, wherein the cavity includes a front wall including an upper half portion, a back wall, and a pair of lateral walls;

a spigot-recess defined on the front wall of the cavity and shaped to engage the spigot, wherein the spigot-recess is located in the upper half portion of the front wall;

a top plate assembly arranged to be alternatingly positioned between an open position and a closed position, the top plate assembly including a pressure plate positioned at a top of the cavity, the pressure plate arranged to apply a downward force on the bag of liquid;

a lifting plate arranged to lift the bag of liquid and to apply an upward force on the bag of liquid, the lifting plate arranged to move in the cavity between a bottom-most position and a top-most position which is different from the bottom-most position; and a lifter assembly interfaced with the lifting plate, the lifter assembly arranged to move the lifting plate to the top-most position; wherein the lifting plate includes a first slope including a top end and a bottom end that is lower than the top end, the top end of the first slope being positioned proximal to the back wall and the bottom end of the first slope being positioned proximal to the front wall;

when the lifting plate is in the top-most position, the bottom end of the first slope is positioned proximal to the spigot recess; and the pressure plate includes a second slope including a top end and a bottom end that is lower than the top end of the second slope, the top end of the second slope being positioned proximal to the back wall and the bottom end of the second slope being positioned proximal to the spigot-recess when the pressure plate assembly is in the closed position.

17. The system of claim 1, wherein the lifter assembly includes at least one guide interfaced with the lifting plate to orient a vertical ascent and descent of the lifting plate, and at least one biasing device arranged to apply a biasing force to one end to the lifting plate.

18. The system of claim 17, wherein the at least one guide includes at least one elongated guide member extending towards a bottom surface of the cavity, and wherein the at least one elongated guide member is interfaced with the lifting plate.

19. The system of claim 18, wherein the at least one elongated guide member includes a front pair of guide posts and a rear pair of guide posts, and the lifting plate includes a front pair of apertures to receive the front pair of guide posts and a rear pair of apertures to receive the rear pair of guideposts.

20. The system of claim 17, wherein the at least one biasing device includes at least one of:

a piston, at least one compression spring configured so that the lifting plate can be depressed by a weight in the range of about 6 lb to about 13 lb, at least one compression spring configured so that the lifting plate can be depressed by a weight in the range of about 0.5 lb to about 3 lb, at least one tension spring configured so that the lifting plate can be depressed by a weight in the range of about 6 lb to about 13 lb, and at least one tension spring configured so that the lifting plate can be depressed by a weight in the range of about 0.5 lb to about 3 lb.

* * * * *